US007918971B2

(12) United States Patent
Takano

(10) Patent No.: US 7,918,971 B2
(45) Date of Patent: Apr. 5, 2011

(54) SHOE PRESS BELT FOR MAKING PAPER

(75) Inventor: Satoshi Takano, Tokyo (JP)

(73) Assignee: Ichikawa Co., Ltd,, Tokyo (JP)

( * ) Notice: Subject to any disclaimer, the term of this patent is extended or adjusted under 35 U.S.C. 154(b) by 0 days.

(21) Appl. No.: 12/530,954

(22) PCT Filed: Mar. 12, 2008

(86) PCT No.: PCT/JP2008/054457
§ 371 (c)(1),
(2), (4) Date: Sep. 11, 2009

(87) PCT Pub. No.: WO2008/126582
PCT Pub. Date: Oct. 23, 2008

(65) Prior Publication Data

US 2010/0101745 A1 Apr. 29, 2010

(30) Foreign Application Priority Data

Mar. 12, 2007 (JP) ..... 2007-062154

(51) Int. Cl.
*D21F 3/02* (2006.01)

(52) U.S. Cl. ..... 162/358.4; 162/901; 428/167

(58) Field of Classification Search ..... 162/205–207, 162/306, 348, 358.3, 358.4, 361, 901; 100/151, 100/153; 428/163, 167, 156, 157; 442/59, 442/148
See application file for complete search history.

(56) References Cited

U.S. PATENT DOCUMENTS 4,482,430 A * 11/1984 Majaniemi ..... 162/358.4
4,559,258 A 12/1985 Kiuchi
5,914,007 A * 6/1999 Henssler et al. ..... 162/205
6,029,570 A 2/2000 Matuschczyk
6,030,503 A * 2/2000 Matuschczyk ..... 162/358.4
6,296,738 B1 10/2001 Ishii
(Continued)

FOREIGN PATENT DOCUMENTS

DE 19752725 * 6/1999
(Continued)

OTHER PUBLICATIONS

U.S. Appl. No. 12/532,175, filed Sep. 21, 2009, Takano et al.

*Primary Examiner* — Eric Hug
(74) *Attorney, Agent, or Firm* — Oblon, Spivak, McClelland, Maier & Neustadt, L.L.P.

(57) ABSTRACT

A belt (shoe press belt) for a paper making machine, which has good ability of squeezing water from moist paper and which, during use, has reduced damage (cracks and wear) on the outer peripheral surface of the belt. The shoe press belt for making paper carries felt for receiving water squeezed from moist paper. A water discharge groove extended on the surface on the felt side is formed as an intermittent groove, and the width and depth of the water discharge groove are continuously varied in the direction of travel (MD direction) of the groove. The shape of the intermittent groove can be asymmetrical or symmetrical at the left and right with respect to the width, or can be formed to have a narrow width at the center of the groove, or can be formed so that the groove is deep at the center. Because the water discharge groove is intermittent, water discharge ability, the quality of paper, and the smoothness of the surface of moist paper are enhanced at the same time.

13 Claims, 8 Drawing Sheets

U.S. PATENT DOCUMENTS

| | | | | |
|---|---|---|---|---|
| 6,929,718 | B2 | 8/2005 | Kimura | |
| 2005/0112332 | A1 | 5/2005 | Billings et al. | |
| 2005/0115100 | A1 | 6/2005 | Fitzpatrick et al. | |
| 2005/0126733 | A1 * | 6/2005 | Fitzpatrick et al. | 162/358.1 |
| 2006/0085998 | A1 | 4/2006 | Herman et al. | |
| 2006/0266489 | A1 | 11/2006 | Takamura | |
| 2007/0256806 | A1 | 11/2007 | Scherb et al. | |

FOREIGN PATENT DOCUMENTS

| | | | |
|---|---|---|---|
| JP | 59 54598 | | 4/1984 |
| JP | 64 61591 | | 3/1989 |
| JP | 2001 98484 | | 4/2001 |
| JP | 2004 36015 | | 2/2004 |
| JP | 3104830 | | 8/2004 |
| JP | 2006 336129 | | 12/2006 |
| WO | 2005 049917 | | 6/2005 |
| WO | 2005 056281 | | 6/2005 |
| WO | 2005 075736 | | 8/2005 |
| WO | WO 2008/148584 | A1 | 12/2008 |

* cited by examiner

SHOE PRESS BELT FOR MAKING PAPER

FIELD OF THE INVENTION

The present invention relates to a shoe press belt used for improving the capability of water squeezing from a wet paper web, and a felt in the press part of a papermaking machine or another similar machine and in particular relates to the groove shape provided along the felt side surface of the shoe press belt.

PRIOR ART

In papermaking, in order to improve productivity, it is a major issue how to increase the dewatering amount from the wet paper web in the press part in which moisture from the wet paper web is removed. As means for increasing the dewatering amount during pressing in order to achieve the object of reducing the moisture in the wet paper web as much as possible, methods such as increasing the pressure applied by the press rolls, increasing the hardness of the press rolls, or extending the time during which the pressure is applied by interposing a shoe press belt and the like are adopted; in recent years, in order to improve the dewatering effect by extending the time during which pressure is applied between the rolls and the felt in the course of pressing, a method in which a shoe press belt is interposed has increasingly come into use.

Moreover, recently examples have increased in which a plurality of grooves is provided along the felt side surface of the shoe press belt in order to efficiently drain the squeezed water. For example, according to Patent document 1, the water squeezing capability of the wet paper web is improved by providing a plurality of water drain grooves in the external peripheral surface of a belt used in a wide-width nip press (the so-called shoe press).

Most grooves in the prior art have a rectangular shape for reasons of productivity, cost and because they can be easily manufactured, but grooves with a curved groove bottom (Patent documents 2 and 3) and grooves with a concave curved top surface at the land part (Patent document 4) have also been proposed. Specifically, Patent document 2 provides a belt with good strength durability and good dewatering capability (water squeezing capability) of the shoe press by forming the groove section in the shape of the letter U, wherein the end parts of the land part of the water drain grooves are chamfered, the groove width is 0.5 to 4 mm, the depth is 0.5 to 5 mm and the space between adjacent water drain grooves is 1 to 4 mm. In Patent document 3, besides the curved groove bottom, the side walls of the grooves also curve towards the outside. The press jacket (press belt) according to Patent document 4 has a plurality of webs (land parts) at its external surface, grooves are interposed between these webs, and each web has a concave curved top surface. Patent document 5, moreover, shows a shoe press belt having a plurality of grooves that are substantially discontinued in the machine direction.

The groove shapes of the shoe press belts in the above-mentioned Patent documents have all been fixed at a single shape (groove width, groove depth, land part width, groove number); and the present situation is that, in view of cracks occurring in the internal groove part, damage, wear, transfer marks of the land part, water squeezing capability and the like, a satisfactory shoe press belt cannot necessarily be obtained.

[Patent document 1] Japanese Utility Model Application No. Sho 57-147931 (Utility Model Laid-open No. 59-54598) microfilm

[Patent document 2] Japanese Utility Model Registration No. 3104830

[Patent document 3] Japanese Patent Application Laid-open No. 2001-98484

[Patent document 4] Japanese Patent Application Laid-open No. Sho 64-61591

[Patent document 5] International Patent Publication No. 2005/049917

DISCLOSURE OF THE INVENTION

Problems to be Solved by the Invention

The present inventors, having extensively studied the technology in the present field, confronted a situation in which, when a belt with a single shape in which the void volume has been increased is used, there is the tendency that cracks in the internal groove part and damage and wear of the land part easily occur and that the paper quality and the smoothness of the wet paper web surface degrade as a result of the pressing (there is an increase in the rate of transfer marks of the groove shape appearing in the wet paper web), and if, on the other hand, the groove width and the groove depth are reduced, the water squeezing capability is deteriorated, which results in an increase of the energy consumption for drying the wet paper after pressing.

In consideration of the above-mentioned problems, it is the object of the present invention to provide a belt (a shoe press belt) for a paper manufacturing machine which has good capability of water squeezing from wet paper web and wherein damage (cracks and wear) of the external peripheral belt surface during use is small.

Means for Solving the Problems

The present inventors have discovered that the above problems can be solved by providing the water drain grooves in the above-mentioned shoe press belt as discontinuous grooves wherein the groove width and/or groove depth continuously change(s) in the same groove, and have completed the present invention.

The present invention basically relates to a shoe press belt for making paper having water drain grooves with a groove shape wherein the groove width and/or the groove depth change(s) continuously in the running direction (MD direction) and is based on the technologies described hereinafter.

(1) A shoe press belt for making paper carrying a felt which absorbs the water squeezed from the wet paper web, wherein said shoe press belt for making paper has water drain grooves in the surface of the felt side extending in the machine running direction (MD direction) and wherein said grooves are discontinuous grooves with a groove shape wherein the groove width and/or groove depth change(s) continuously.

(2) A shoe press belt for making paper according to (1), wherein the groove width at the central part of the discontinuous grooves is wider than the groove width of at least one of the running direction (MD direction) end parts.

(3) A shoe press belt for making paper according to (1), wherein the groove width at the central part of the discontinuous grooves is narrower than the groove width of at least one of the running direction (MD direction) end parts.

(4) A shoe press belt for making paper according to (1) or (2), wherein the groove shape is tapered towards both end parts of the discontinuous grooves.

(5) A shoe press belt for making paper according to any one of (1) to (4), wherein the groove shape of the discontinuous grooves is left/right unsymmetrical along the MD direction as axis.

(6) A shoe press belt for making paper according to any one of (1) to (4), wherein the groove shape of the discontinuous grooves is left/right symmetrical along the MD direction as axis.

(7) A shoe press belt for making paper according to any one of (1) to (6), wherein the groove depth at one end part of the discontinuous grooves is greater than the groove depth at the other end part.

(8) A shoe press belt for making paper according to any one of (1) to (6), wherein the groove depth at the central part of the discontinuous grooves is greater than the groove depth of at least one end part.

(9) A shoe press belt for making paper according to any one of (1) to (8), wherein the groove length of the discontinuous grooves is shorter than the width of the press shoe.

(10) A shoe press belt for making paper according to any one of (1) to (8), wherein the groove length of the discontinuous grooves is equal to the width of the press shoe or in a range of up to two times the width of the press shoe.

In the present specification, the term discontinuous grooves signifies water drain grooves wherein land parts where grooves are not formed and groove bottom parts where grooves are formed are alternately arranged in the MD direction. Moreover, in the present specification, the term central part of the discontinuous grooves signifies the central part of said groove bottom part in the MD direction, the term end part of the discontinuous grooves signifies the end parts in the MD direction of the same groove bottom part, and the term groove length of the discontinuous grooves signifies the groove length in the MD direction of the groove bottom part. Furthermore, in the present specification, in the case of one end part of the discontinuous grooves and the other end part of the discontinuous grooves as well as in the case of both end parts, respectively, the term end part(s) signifies the end part(s) in the same groove bottom part of the discontinuous grooves.

The Effect of the Invention

According to the present invention, it is possible to prevent the reverse flow of water at the nip entrance by configuring the water drain grooves as discontinuous grooves in the above-mentioned shoe press belt, the water is received below the nip and can be forcibly ejected by the action of the pressure at the exit, therefore, backwater does not occur in the low speed region and normal dewatering is possible during pressing.

Moreover, by configuring the same groove so that the groove width and groove depth are bigger at the central part than at the end parts, water enters the groove under the nip more easily and the water in the groove is drained more easily at the nip exit, therefore, it is possible to obtain advantageous water squeezing capabilities and to provide a shoe press belt for making paper wherein the water drainage is improved and, at the same time, the paper quality and surface smoothness of the wet paper web are also improved.

EXPLANATION OF THE SYMBOLS

Figure 1:
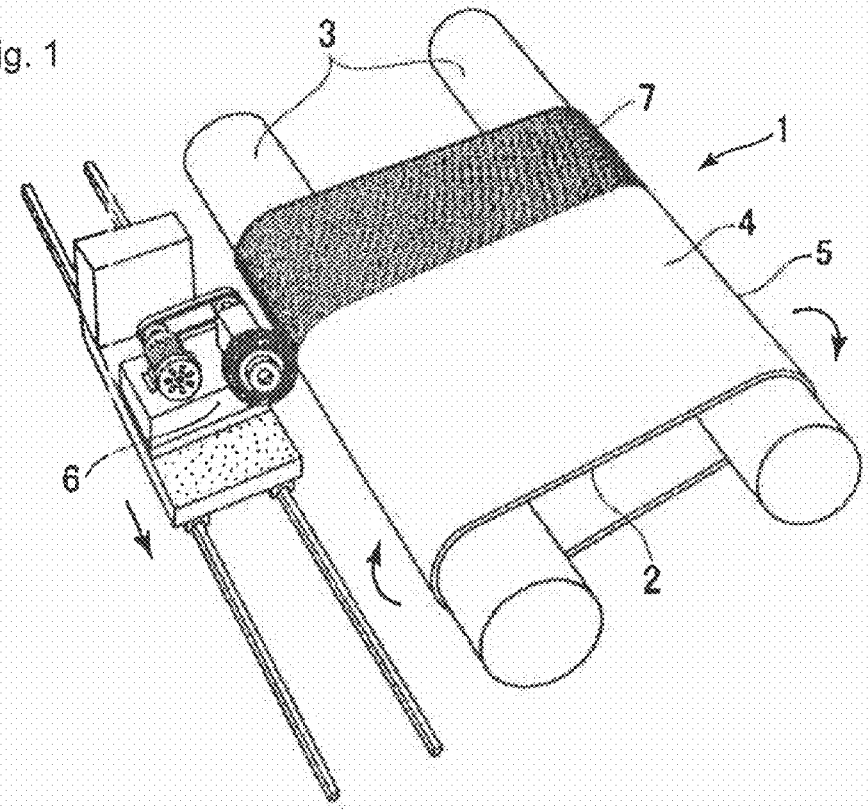
FIG. 1 is a device for forming the water drain grooves of a shoe press belt according to the present invention.

1: Water drain groove forming device
2: Substrate
3: Roll
4: Polyurethane layer
5: External peripheral surface
6: Groove cutting device
7: Water drain groove
8: Embossing blade
9: Flywheel
10: Drive motor
11: Counter roll
12: Machining piece
S: Test specimen
CH: Cramp hand
PR: Press roll
PS: Press shoe
B: Belt
N: Nozzle
W: Water flow
Ft: Top felt
Fb: Bottom felt
WS: Wet paper sheet

PREFERRED EMBODIMENTS OF THE INVENTION

The embodiments of the present invention will now be explained with reference to the figures.

FIG. 1 is a schematic diagram of device 1 for forming (embossing) the water drain grooves of a shoe press belt for making paper according to the present invention.

Firstly, an endless substrate 2 is placed around two rolls 3, 3 and stretched with a prescribed force. This roll 3 can rotate and the substrate 2 travels in the direction of rotation of the roll 3. Under such conditions liquid polyurethane is applied from above the substrate 2, which hardens and forms a polyurethane layer 4 over the entire periphery of the substrate 2. Then, a groove cutting device 6 is used to form discontinuous water drain grooves 7 on the external peripheral surface 5 of the substrate 2 on which the polyurethane layer 4 has been provided.

Figure 2:
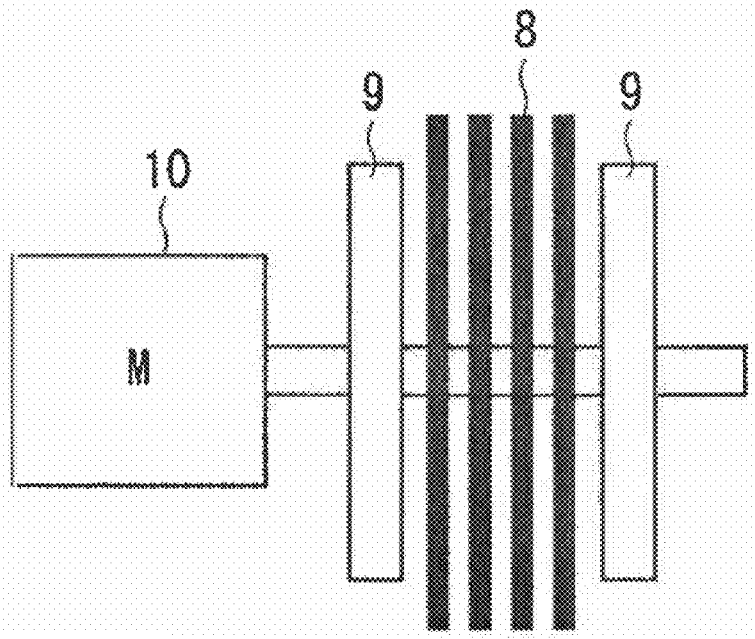
FIG. 2 is a view explaining the arrangement of the cutting blades used for forming the grooves according to the present invention.

As shown in FIG. 2, the groove cutting device 6, wherein embossing blades 8 for forming the grooves are arranged in multiple rows, comprises a drive motor 10 and support members (flywheels 9).

Figure 3:
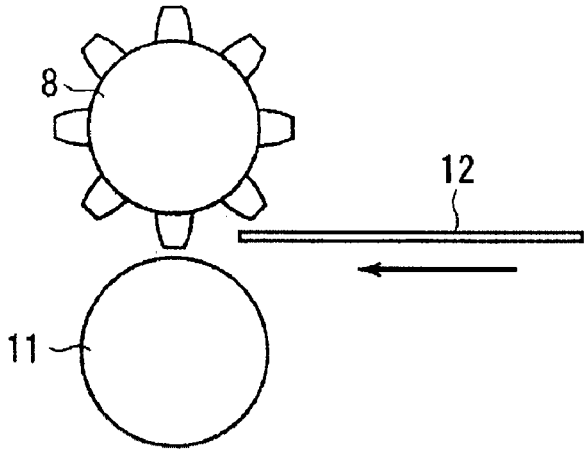
FIG. 3 is a view showing the forming method of the groove shape according to the present invention.

In the embossing, as shown in the schematic diagram of FIG. 3, the machining piece 12 is formed by the embossing blades 8 when the machining piece passes between the embossing blades 8 and the counter roll 11. The polyurethane layer 4 can be easily formed by heating the embossing blades preferably to a temperature of 200° C. or more.

Figure 4:
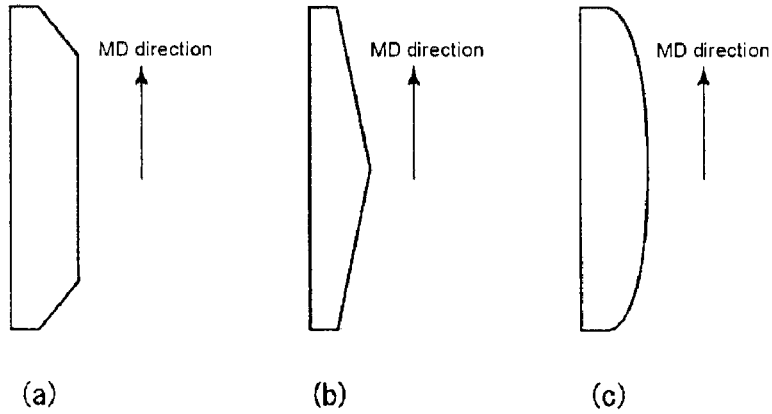
FIG. 4 is a view showing first embodiments of the groove shape according to the present invention.
Figure 5:
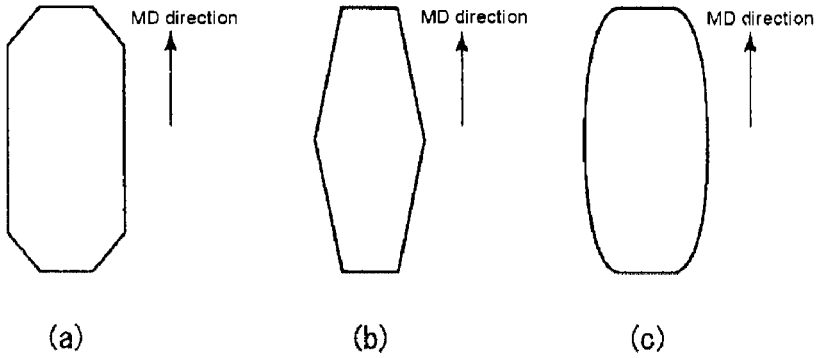
FIG. 5 similarly is a view showing first embodiments of the groove shape according to the present invention.

Regarding the groove shapes of the present invention, to start with, examples of the first embodiment are shown in FIGS. 4, 5. In the groove shapes shown in FIGS. 4, 5, the groove width at the central part of the discontinuous grooves, where the amount of deformation is big, is bigger than the width of at least one of the MD direction end parts. The groove shape preferably has left/right symmetry (FIG. 5).

When the discontinuous groove passes the press nip, the elastic resin layer of the press belt is compressed and deformed so that the groove width becomes narrower. The further away from the land part, the bigger the degree of this deformation; therefore, the whole of the discontinuous groove is deformed so that the central part becomes narrower. Consequently, in order to maintain the water holding capacity of the groove, the width of the central part of the discontinuous groove, where the amount of deformation is big, is made bigger than the width of at least one of the MD direction end parts. Since the deformation force acting on the groove is left/right identical, the groove shape is preferably left/right symmetrical.

Figure 6:
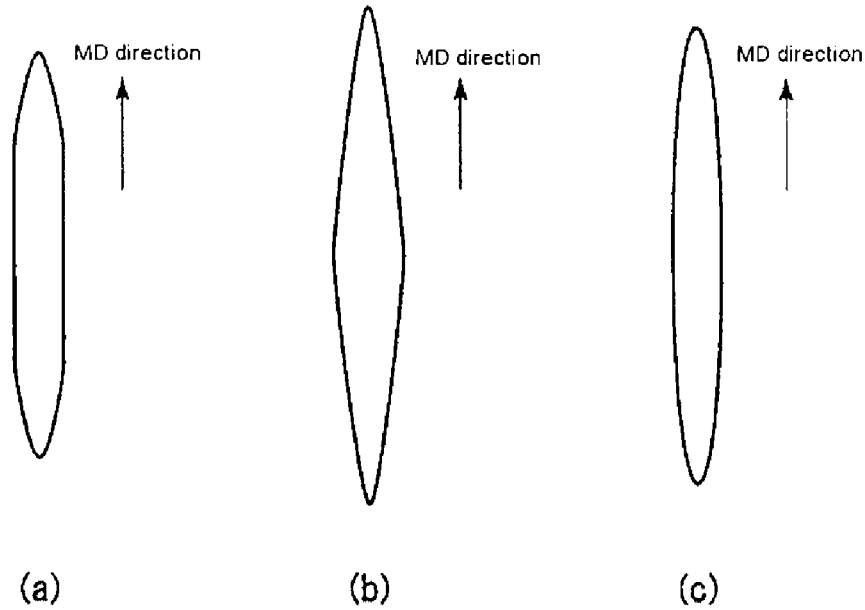
FIG. 6 is a view showing variations of the first embodiments of the groove shape according to the present invention.

Furthermore, the groove shapes of FIG. 6, as variations of the first embodiments, are tapered at both end parts in the running direction (MD direction); therefore, the deformation force acting on both end parts in the MD direction is smaller than in the case of the groove shapes of FIG. 5.

Figure 7:
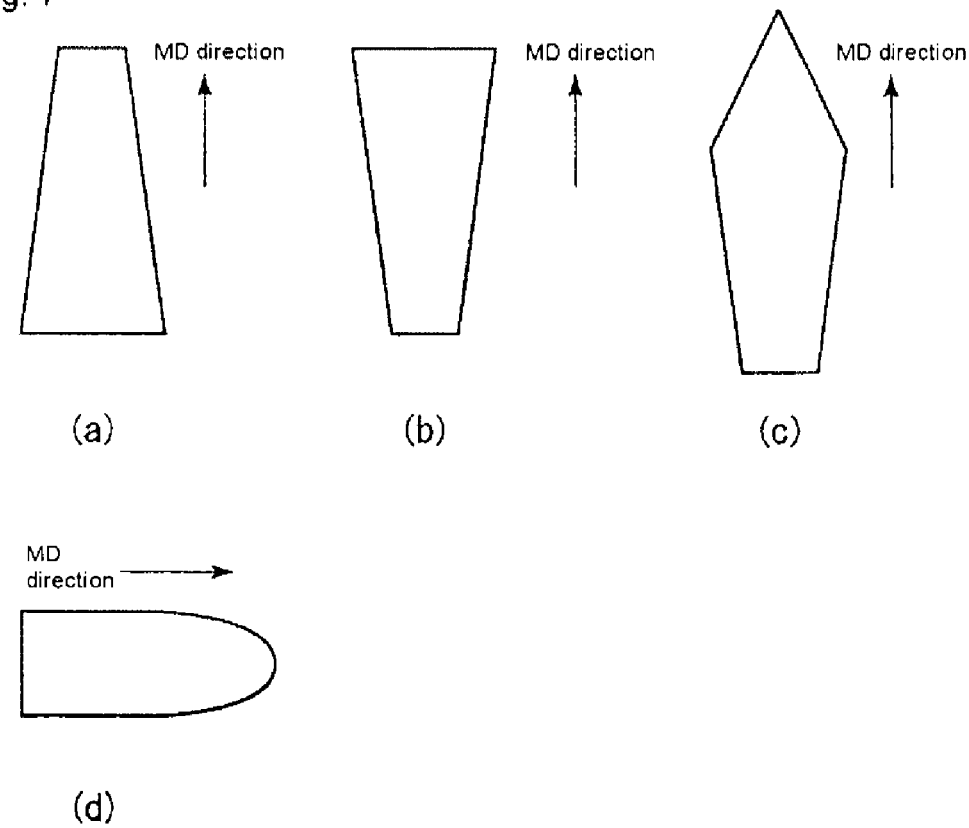
FIG. 7 is a view showing second embodiments of the groove shape according to the present invention.
Figure 8:
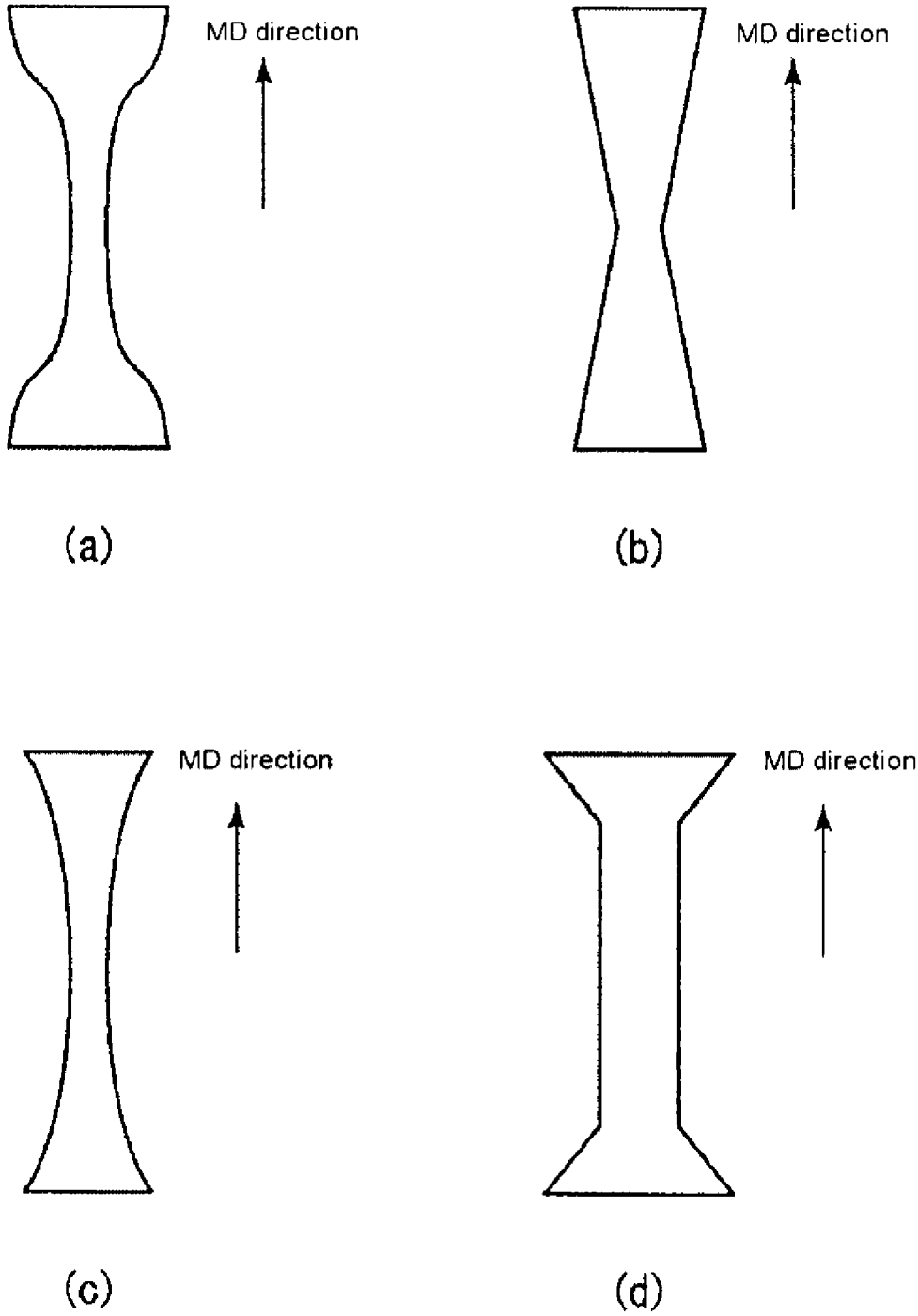
FIG. 8 similarly is a view showing second embodiments of the groove shape according to the present invention.

Examples of the second embodiment of the groove shapes according to the present invention are shown in FIGS. 7, 8. In the shapes of FIG. 7 and FIG. 8, the width at the central part of the discontinuous grooves is narrower than the width of at least one of the MD direction end parts.

In a discontinuous groove having an MD direction groove length shorter than the width of the press shoe, the greatest force is obtained at the press center (the greatest force occurs in a water volume retained in a closed groove); therefore, in order to reduce the flow resistance at the press exit and to eject the retained water easily, the width of the central part of the discontinuous grooves is made narrower than the width of at least one of the MD direction end parts. At the press exit, it is preferred that the MD direction end part that opens first is wider than the central part of the discontinuous groove.

Figure 9:
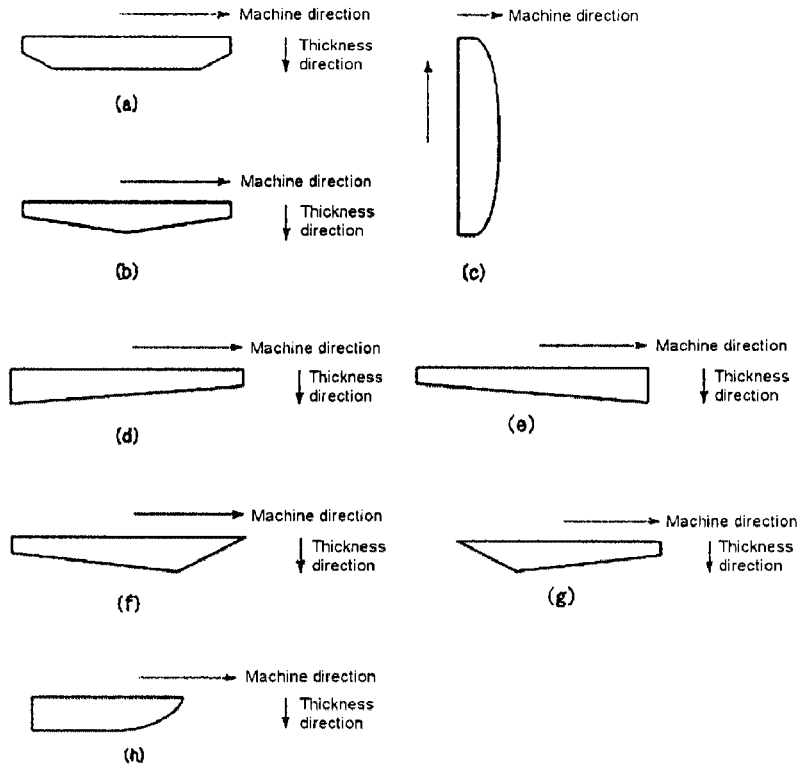
FIG. 9 is a view showing third embodiments of the groove shape according to the present invention.

In the examples of the third embodiment of the groove shapes according to the present invention shown in FIG. 9, the central part of the discontinuous grooves is deeper than at least one of the MD direction end parts. The central part of the discontinuous groove is preferably deeper than the front end part in the MD direction.

When the discontinuous groove passes the press nip, the elastic resin layer of the press belt is compressed and deformed so that the groove becomes shallower. The further away from the land part, the bigger the degree of this deformation; therefore, the central part of the discontinuous groove section is most deformed. Consequently, in order to maintain the water holding capacity of the groove, the central part of the discontinuous groove, where the deformation is big, is made deeper than at least one of the MD direction end parts. And since the deformation force acting on the groove is identical in front-back, the groove shape is preferably symmetrical in front-back.

Moreover, in order to reduce the flow resistance at the press exit and easily eject the retained water, the front end part in the MD direction is preferably deeper than the central part of the discontinuous groove, or it is curved at an inclination.

Groove dimensions in the following ranges can be adopted: groove width=0.5 to 2 mm, groove depth=0.5 to 2 mm and the space of the land part between adjacent water drain grooves=1 to 5 mm; with configurations in these ranges, the distance (clearance) between the external peripheral surface 5 of the belt and the groove cutting device 6 (embossing blades 8) is suitably adjusted.

As mentioned above, the MD direction groove length of the discontinuous grooves according to the present invention is preferably shorter than the width of the press shoe (the MD direction length of the shoe) because the greatest force, which is very strong, occurs due to a water volume retained in a closed groove. Shoe presses for the press part of a papermaking machine come in many different widths; however, most are in the range of about 50 to 400 mm; therefore, the MD direction groove length of the discontinuous grooves according to the present invention is set, shorter than the press shoe width, within the range of 40 to 390 mm; while the width of long discontinuous grooves equal to the width of the press shoe or in a range of up to two times the width of the press shoe can be set in the range of 50 to 800 mm.

By chamfering the end parts of the land part where no grooves are formed, damage and broken edges of the end parts are avoided.

By suitably adjusting the distance between the external peripheral surface of the belt and the cutting blades, it is possible to form continuous or discontinuous grooves in the MD direction. In the case of discontinuous grooves, it is possible to mechanically pull and push the embossing blades by the pulling and pushing action, and the like, at a fixed time interval with a thickness adjusting motor. It is also possible to rotate fixed blades in an elliptical orbit.

Moreover, in the case of a discontinuous groove, an embodiment of a tapered shape is preferred in which the depth inside the groove changes continuously in the MD direction and the thickness of the border part thereof is gradually reduced.

(Performance Evaluation Method)

The performance of the shoe press belts produced was evaluated by the tests hereinafter, and the overall evaluation was performed by attributing a ranking.

(Crack Test)

Figure 18:
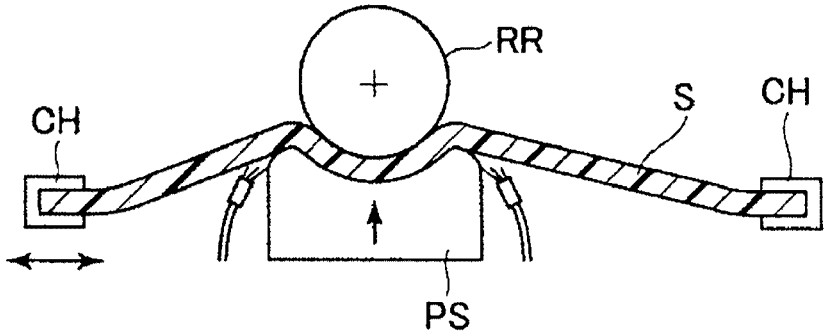
FIG. 18 is a view showing a device used for crack testing.

The device shown in FIG. 18 was used. In this device, both ends of a specimen S are pinched by crank hands CH, CH; the crank hands CH, CH are configured so that they can move in unison back and forth in the left/right directions. Moreover, the force applied on the specimen S was 3 kg/cm; and the speed of the back and forth movement was 40 cm/sec. The specimen S was pressed by the press roll RR and the press shoe PS. Then, the specimen S was pressed by the displacement of the press shoe PS in the direction of the press roll RR.

The pressing force moreover was 36 kg/cm$^2$. This device measures the frequency of the back and forth movement until cracks occur. Furthermore, the evaluation surface of the specimen S was the side facing the press roll RR. The frequency until cracks occur was:

Evaluation score A: 260,000 times or more,

Evaluation score B: in the range between 120,000 and 260,000 times,

Evaluation score C: 120,000 times or less.

(Water Squeezing Test)

Figure 19:
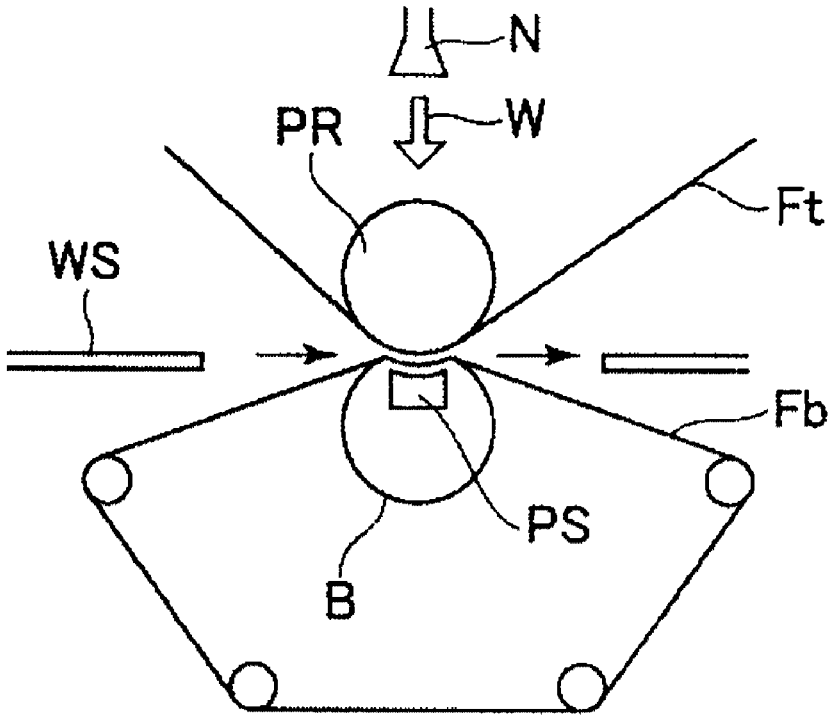
FIG. 19 is a schematic diagram of a water squeeze test.

The water squeezing test of wet paper web was performed by using the device shown in FIG. 19. In the present test device, the belt B was placed in a position facing the press roll PR, and the press shoe PS (shoe width; 50 mm) was placed in the internal periphery of said belt so as to press the belt B against the press roll PR. Furthermore, a top felt and a bottom felt F, both of which were made by integrating (flocking) a staple fiber of 11 dtex nylon 6 with a base fabric by needle punching so as to obtain a basis weight of 1500 g/m$^2$, were placed between the press roll PR and the belt B. Then the belt B ran at a traveling speed of 1000 m/min. under a nip pressure of 1000 kN/m between the press roll PR and the press shoe PS. After which a water flow W was ejected from a nozzle N installed above the press roll PR at a pressure of 3 kg/cm$^2$ and a rate of 15 liters/min. At that time, the top roll was covered by a film from the water flow W, and after penetrating the top felt Ft and the bottom felt Fb, the water flow W also reached the belt B. Under such conditions a wet paper sheet WS having 70% moisture content was placed on the bottom felt Fb and passed through the nip; after passing the nip, the moisture content of the wet paper sheet WS was measured. The wet paper web moisture content was:

Evaluation score A: 45% or less,

Evaluation score B: in the range between 45% and 53%,

Evaluation score C: 53% or more.

(Ranking)

Regarding the test results, the overall evaluation was performed based on the respective evaluation scores of the above tests, and the ranking was attributed as follows:

All evaluation scores were A: Ranking 1

One evaluation score was A and the others were B: Ranking 2

All evaluation scores were B: Ranking 3

One of the evaluation scores was C: Ranking 4

Regarding the shoe press belts of the above-mentioned constitution, specifically, the shoe press belts of Examples 1 to 9 and the Comparative Example 1 were produced by the processes described hereinafter.

Process 1: the device shown in FIG. 1 was used; an endless substrate 2 was engaged between 2 rolls and stretched with a prescribed force.

Process 2: liquid polyurethane was applied from above the substrate 2, which hardens and forms a polyurethane layer 4 over the entire periphery of the substrate 2.

Process 3: embossing blades 8 for embossing were installed in the groove cutting device 6. The embossing blades 8 are maintained at a temperature of 250° C. by an internal heater. The respective groove shapes in the Examples and in the Comparative Example were formed by the shapes of these embossing blades 8.

Moreover, the groove shapes were adjusted in the ranges given hereinafter.

(1) Groove width: 1.2 mm at the wide part, 0.8 mm at the narrow part.

(2) Groove depth: 1.5 mm at the deep part, 0.8 at the shallow part.

(3) Width of the land part between adjacent water drain grooves in the CMD direction: 1.5 mm at the narrow part, 1.9 mm at the wide part.

(4) Width of the land part between adjacent water drain grooves in the MD direction: fixed at 5.0 mm (5) Length of the discontinuous grooves in the MD direction: 40 mm (shorter than the width of 50 mm of the press shoe PS in the test device of FIG. 19).

In order to form the grooves in the external peripheral surface of the belt, the distance between the external peripheral surface 5 of the belt and the embossing blades 8 was suitably adjusted during operation so as to form discontinuous grooves in the MD direction.

EXAMPLE 1

Figure 10:
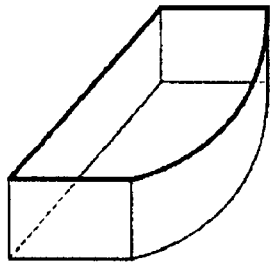
FIG. 10 is a three-dimensional view showing the groove shape of FIG. 4(*c*).

Embossing blades for embossing are installed so as to form the groove shape of FIG. 4(*c*). These blades are configured so that the groove width is wider at the central part of the discontinuous grooves than at both end parts in the MD direction. By machining with these blades, the groove shape becomes curved at both end parts in the MD direction. The groove shape of Example 1 is shown in the three-dimensional view of FIG. 10.

EXAMPLE 2

Figure 11:
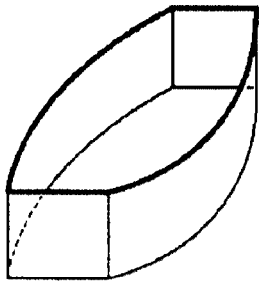
FIG. 11 is a three-dimensional view showing the groove shape of FIG. 5(*c*).

Embossing blades for embossing are installed so as to form the groove shape of FIG. 5(*c*). These blades are configured so that they are left/right symmetrical versions of the blades of FIG. 4(*c*) and so that the groove width is wider at the central part of the discontinuous grooves than at both end parts in the MD direction. By machining with these blades, the groove shape becomes curved at both end parts in the MD direction. The groove shape of Example 2 is shown in the three-dimensional view of FIG. 11.

EXAMPLE 3

Figure 12:
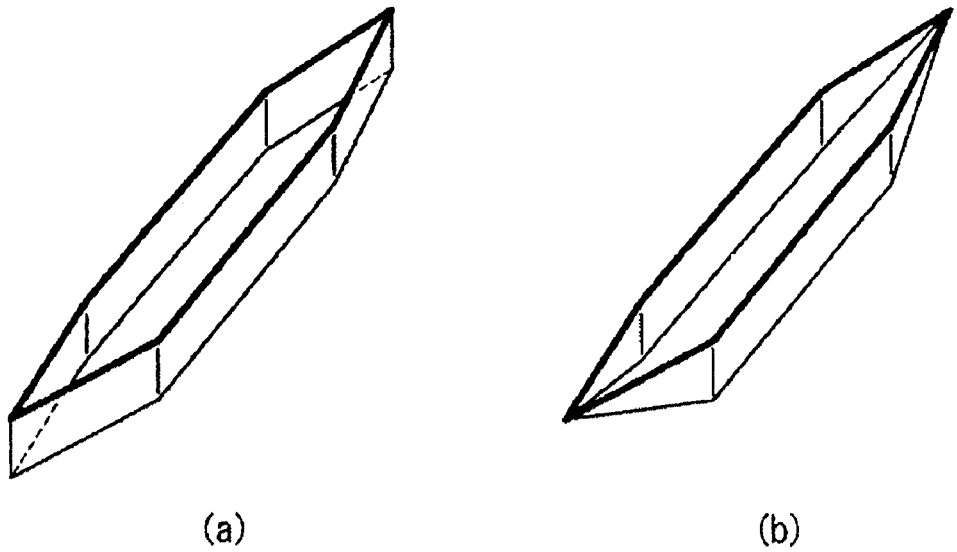
FIG. 12 is a three-dimensional view showing the groove shape of FIG. 6(*a*) and a variation thereof.

Embossing blades for embossing are installed so as to form the groove shape of FIG. 6(*a*). By machining with these blades, which are configured like the blades of FIG. 6(*a*), the groove shape becomes tapered at both end parts in the MD direction. The groove shape of Example 3 is shown in the three-dimensional view of FIG. 12(*a*). Moreover, instead of the embossing blades for embossing, cutting blades for groove cutting can also be installed so as to form the groove shape of FIG. 6(*a*). It is possible to use normal metal saw blades or chip saw blades which cut a continuous groove shape in the belt. By suitably adjusting the distance between the external peripheral surface of the belt and the cutting blades, it is possible to form discontinuous grooves in the MD direction; it is moreover possible to configure a shape wherein the groove depth in the same groove is shallower at both end parts in the MD direction than at the central part. It is also possible to form such grooves by rotating fixed blades in an elliptical orbit so that they are discontinuous and tapered and so that the groove shape is shallow at both end parts. By machining with these blades, the groove shape can be configured so that it is tapered at both end parts in the running direction (MD direction) of the belt and so that both end parts in the MD direction are shallower than the central part. This groove shape is shown in the three-dimensional view of FIG. 12(*b*).

EXAMPLE 4

Figure 13:
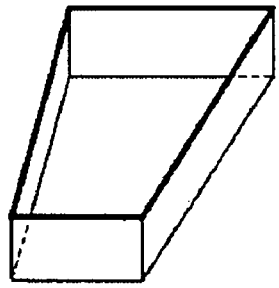
FIG. 13 is a three-dimensional view showing the groove shape of FIG. 7(*b*).

Embossing blades for embossing are installed so as to form the groove shape of FIG. 7(*b*). These blades are configured so that the groove width is narrower at the central part of the discontinuous grooves than at one end part in the MD direction. By machining with these blades, the width of the groove shape is configured wider at the front end part in the running direction (MD direction) than at the rear end part. The groove shape of Example 4 is shown in the three-dimensional view of FIG. 13.

EXAMPLE 5

Figure 14:
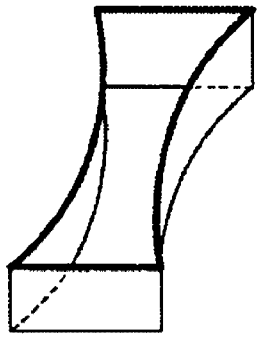
FIG. 14 is a three-dimensional view showing the groove shape of FIG. 8(*c*).

Embossing blades for embossing are installed so as to form the groove shape of FIG. 8(*c*). These blades are configured so that the groove width is narrower at the central part of the discontinuous grooves than at both end parts in the MD direction. By machining with these blades, the groove shape can be configured so that it is curved at both end parts in the MD direction and so that the width of the groove shape is shallower at the central part of the groove than at both end parts in the MD direction. The groove shape of Example 5 is shown in the three-dimensional view of FIG. 14.

EXAMPLE 6

Figure 15:
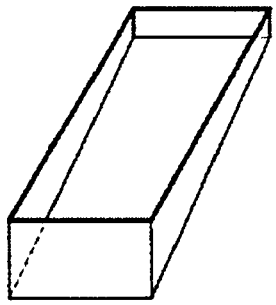
FIG. 15 is a three-dimensional view showing the groove shape of FIG. 9(*d*).

Embossing blades for embossing are installed so as to form the groove shape of FIG. 9(*d*). These blades are configured so that one end part in the MD direction is deeper than the other end part in the MD direction. By machining with these blades, the front end part in the MD direction can be configured shallower than the rear end part. The groove shape of Example 6 is shown in the three-dimensional view of FIG. 15.

EXAMPLE 7

Figure 16:
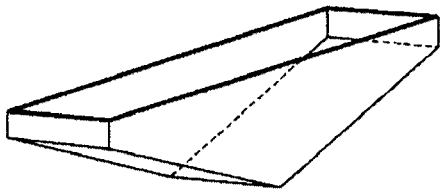
FIG. 16 is a three-dimensional view showing the groove shape of FIG. 9(*b*).

Embossing blades for embossing are installed so as to form the groove shape of FIG. 9(*b*). These blades are configured so that the central part of the groove is deeper than at least one end part in the MD direction. By machining with these blades, the central part in the MD direction can be configured deeper than at least one end part in the MD direction. The groove shape of Example 7 is shown in the three-dimensional view of FIG. 16.

EXAMPLE 8

The groove shape in this Example is identical to the one in Example 7; in Example 8, the length of the discontinuous grooves in the MD direction is adjusted to 50 mm, which is identical to the press shoe width (50 mm) of the present test device.

EXAMPLE 9

The groove shape in this Example is identical to the one in Example 7; in Example 9, the length of the discontinuous grooves in the MD direction is adjusted to 80 mm, which is longer than the press shoe width (50 mm) of the present test device.

Comparative Example

Figure 17:
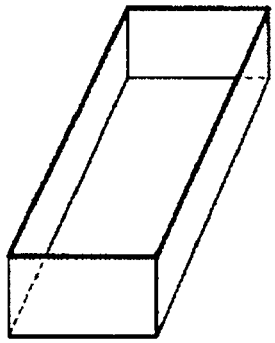
FIG. 17 is a three-dimensional view showing a rectangular groove shape.

Embossing blades for embossing are installed so as to form a general rectangular groove shape. These blades are configured so that the central part of the grooves and both end parts in the MD direction have a fixed width. By machining with these blades, the groove shape at both end parts in the MD direction becomes rectangular. This is used for Comparative Example 1, the groove shape of which is shown in the three-dimensional view of FIG. 17.

Regarding the shoe press belts relating to Examples 1 to 9 and Comparative Example 1, crack tests and water squeezing tests were performed and the performance was evaluated. The results thereof are shown in Table 1.

TABLE 1

| | Crack test | Water squeezing test | Ranking |
|---|---|---|---|
| Example 1 | A | B | 2 |
| Example 2 | A | A | 1 |
| Example 3 | A | B | 2 |
| Example 4 | B | A | 2 |
| Example 5 | B | A | 2 |
| Example 6 | B | B | 3 |
| Example 7 | A | A | 1 |
| Example 8 | A | B | 2 |
| Example 9 | A | B | 2 |
| Comparative Example 1 | B | C | 4 |

According to the results of Table 1, good evaluations were obtained in two evaluation tests with the groove shapes of Example 2 and Example 7, which are the groove shapes with the best balance.

Moreover, in Examples 8 and 9, in which the length of the discontinuous grooves in the MD direction was, respectively, identical and longer than the width of the press shoe, the evaluation of the water squeezing tests showed results inferior to those of the comparable Example 7; however, the ranking was by no means inferior.

INDUSTRIAL APPLICABILITY

The shoe press belt according to the present invention is most useful for improving the water squeezing capability of a wet paper web and a felt in the press part of a papermaking machine or another similar machine because it can improve the water drainage and, at the same time, improve the paper quality and the surface smoothness of the wet paper web.

The invention claimed is:

1. A shoe press belt for making paper which is placed between a press roll and a shoe, which carries a felt for receiving water squeezed from a wet paper web, and which is pressed towards the press roll at high pressure; said shoe press belt for making paper comprising:

water drain grooves that substantially extend in a machine direction in the surface of a felt side of the press belt;

wherein said water drain grooves have a long discontinuous shape in which a width in a central part of each groove is broader than a width of at least one of machine direction end parts of each groove.

2. A shoe press belt for making paper according to claim 1, wherein the groove shape is tapered towards both machine direction end parts of each water drain groove.

3. A shoe press belt for making paper according to claim 1, wherein the groove shape of each water drain groove is left/right unsymmetrical on the groove width.

4. A shoe press belt for making paper according to claim 1, wherein the groove shape of each water drain groove is left/right symmetrical on the groove width.

5. A shoe press belt for making paper according to claim 1, wherein a machine direction groove length of each water drain groove is shorter than a width of the press shoe.

6. A shoe press belt for making paper according to claim 1, wherein a machine direction groove length of each water drain groove is equal to a width of the press shoe or in a range of up to two times the width of the press shoe.

7. A shoe press belt for making paper according to claim 1, wherein a groove depth at one machine direction end part of each water drain groove is different from a groove depth at the other part in one said groove.

8. A shoe press belt for making paper according to claim 1, wherein a groove depth at one machine direction end part of each water drain groove is greater than a groove depth at the other machine direction end part in one said groove.

9. A shoe press belt for making paper according to claim 1, wherein a groove depth at the central part of each water drain groove is greater than a groove depth of at least one machine direction end part in one said groove.

10. A shoe press belt for making paper according to claim 2, wherein edges of the tapered end parts of each water drain groove have an acute angle.

11. A shoe press belt for making paper according to claim 1, wherein the groove shape is a ship form.

12. A shoe press belt for making paper according to claim 1, wherein an edge of each water drain groove is parallel to the machine direction at least in the central part of the water drain groove.

13. A shoe press belt for making paper according to claim 1, wherein a length of the water drain groove is substantially greater than the width of the central part of the groove.

* * * * *